US006662964B2

(12) United States Patent
Higuchi

(10) Patent No.: US 6,662,964 B2
(45) Date of Patent: Dec. 16, 2003

(54) SYNTHETIC RESIN LIQUID CONTAINER

(75) Inventor: Mitsuo Higuchi, Yamanashi (JP)

(73) Assignee: Gohsho Company, Ltd., Yamanashi (JP)

( * ) Notice: Subject to any disclaimer, the term of this patent is extended or adjusted under 35 U.S.C. 154(b) by 122 days.

(21) Appl. No.: 09/899,847

(22) Filed: Jul. 9, 2001

(65) Prior Publication Data

US 2002/0023929 A1 Feb. 28, 2002

Related U.S. Application Data

(62) Division of application No. 09/648,635, filed on Aug. 28, 2000, now abandoned.

(51) Int. Cl.[7] ..... B65D 6/18

(52) U.S. Cl. ..... 220/667; 220/666; 215/900; 215/11.3

(58) Field of Search ..... 220/666, 667, 220/375; 215/11.3, 900; 222/527

(56) References Cited

U.S. PATENT DOCUMENTS

| | | | | |
|---|---|---|---|---|
| 2,723,779 A | * | 11/1955 | Parker et al. | 215/2 |
| 3,083,877 A | | 4/1963 | Gash | |
| 3,301,293 A | | 1/1967 | Santelli | |
| 3,390,821 A | | 7/1968 | Mullan | |
| 4,256,154 A | * | 3/1981 | Black | 141/338 |
| 4,492,313 A | | 1/1985 | Touzani | |
| 4,873,100 A | | 10/1989 | Dirksing et al. | |
| 4,979,242 A | * | 12/1990 | Maggio | 135/901 |
| 5,080,149 A | | 1/1992 | Peoples | |
| 5,226,551 A | * | 7/1993 | Robbins, III | 215/13.1 |
| 5,255,808 A | * | 10/1993 | Tobler | 206/218 |
| 5,348,173 A | * | 9/1994 | Norwood | 206/509 |
| 5,384,138 A | | 1/1995 | Robbins, III et al. | |
| 5,398,837 A | * | 3/1995 | Degrassi | 215/306 |
| 5,573,129 A | | 11/1996 | Nagata et al. | |
| 5,584,413 A | * | 12/1996 | Jung | 215/382 |
| 6,223,932 B1 | * | 5/2001 | Usui | 215/382 |

FOREIGN PATENT DOCUMENTS

| | | |
|---|---|---|
| FR | 2 607 109 | 11/1986 |
| JP | 3-289447 | 3/1990 |

* cited by examiner

*Primary Examiner*—Stephen Castellano

(57) ABSTRACT

A synthetic resin liquid container for containing drinking water, juice, milk and other liquids is provided. The synthetic resin liquid container has a body that can substantially reduce its volume when a vertical and/or twisting stress is applied to the body, and a form-retaining means to be used after compression of the container body for keeping it compressed.

12 Claims, 12 Drawing Sheets

SYNTHETIC RESIN LIQUID CONTAINER

This application is a divisional application of U.S. Application No. 09/648,635 filed on Aug. 28, 2000, now abandoned.

BACKGROUND OF THE INVENTION

1. Field of the Invention

The present invention relates to a synthetic resin liquid container for containing drinking water, juice, milk and other liquids.

2. Description of the Related Art

Today, it is said that an ordinary family produces garbage at an average of 800 g per day. And the total amount of garbage produced by not only families but also plants and offices all over the world may reach astronomical figures. Therefore, waste disposal is one of the biggest social issues of today. Recently, synthetic resin containers called "mini bottles" have come into wide use and demand for such bottles has dramatically increased. In fact, the amount of waste mini bottles occupies not less than 15% of the above-described total amount of garbage, as the Director General of the Environment Agency reported.

Therefore, recycling these synthetic resin containers, which are difficult to incinerate, has been suggested. And now, separate collection of garbage is generally carried out by separating garbage into several categories such as "food garbage", "synthetic resin container" and others.

The problem is to collect empty synthetic resin containers since such containers are bulky and thus occupy a lot of space so that transporting these empty containers is like carrying air. Further, the fact that recycling service companies are generally paid based on the weight of garbage they recovered may contribute to their unwillingness for collecting such containers.

SUMMARY OF THE INVENTION

Accordingly, an object of the present invention is to provide a synthetic resin container that can be sufficiently resistant to intense oscillation during transport while containig liquid therein and can substantially reduce its volume when it is empty and collected as garbage, thereby enabling transporting much larger number of containers at one time.

A synthetic resin liquid container is provided which has a body that can substantially reduce its volume when a vertical and/or twisting stress is applied to the body, and a form-retaining means to be used after compression of the container body for keeping it compressed.

In one aspect of the present invention, the container body comprises a relatively hard and thin side wall with accordion-shaped contour formed on its surface, and sequentially reduced radiuses from both the upper and bottom ends toward the middle of the body, for facilitating operation of substantially reducing the volume of container as described above.

In another aspect of the present invention, the container body comprises a plurality of longitudinal grooves on the surface of its side wall, and a star-shaped cross section, for facilitating operation of substantially reducing the volume of container as described above.

In still another aspect of the present invention, the container body comprises a relatively hard and thin side wall, and a number of continuous or non-continuous oblique grooves on the side wall, for facilitating operation of substantially reducing the volume of container as described above.

In still another aspect of the present invention, the container body comprises a relatively thin side wall and a number of recesses formed thereon, for facilitating operation of substantially reducing the volume of container as described above.

In still another aspect of the present invention, the container body further comprises a belt attached to the opening of the container body, and the belt is in turn connected to a cap, for an aid in keeping the container compressed.

In still another aspect of the present invention, the opening of the container body can be embedded into the container body by pressing the opening for keeping the container compressed.

In still another aspect of the present invention, the container body also comprises a retainer means which is shorter than the height of the body and has a plurality of legs suspended from the neck portion of the body, with each leg having a claw portion at the tip which engages with the rim of the bottom of the container body for retaining the substantially reduced volume of the container body.

Alternatively, in still another aspect of the present invention, the container body also has a retainer member provided on the lower portion of the body, the retainer member having a sidewall which is shorter than that of the body, extends in upward direction and has, at the circumferential rim of the side wall thereof, a claw that can be engaged with the top of side wall of the container body.

DESCRIPTION OF THE PREFERRED EMBODIMENT

EXAMPLE 1

Figure 1:
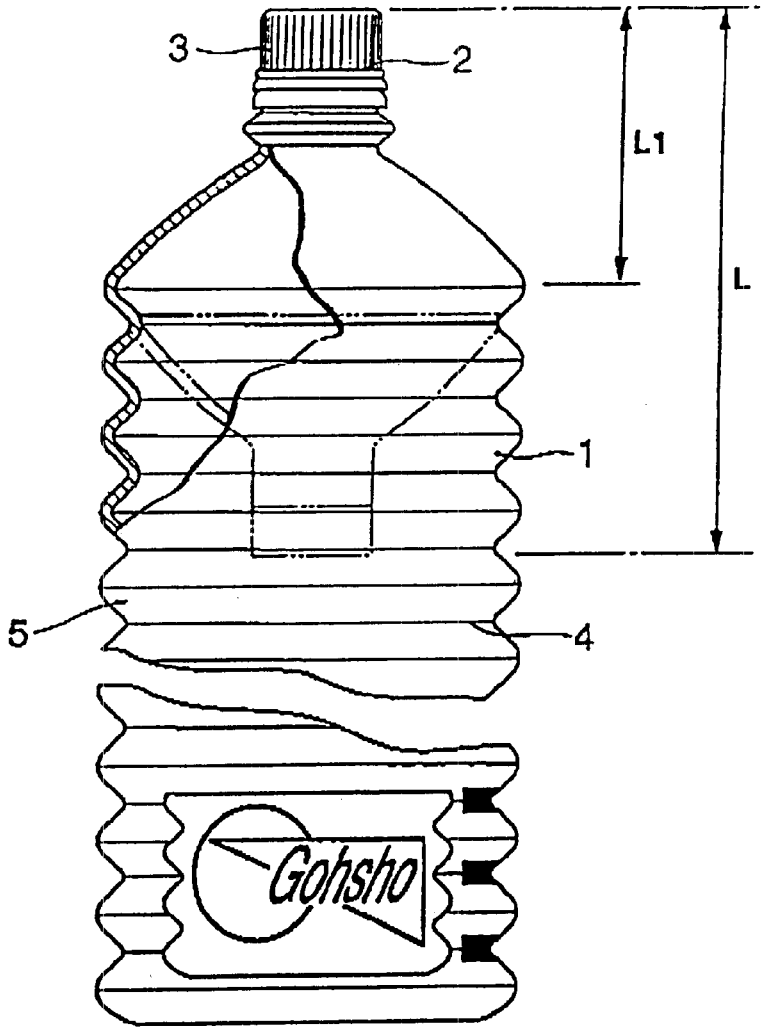
FIG. 1 shows a front view of the container body of the present invention according to Example 1.

FIG. 1 shows a liquid container body (1) made of flexible plastic synthetic resin, and a relatively hard opening (2) with reduced radius provided at the top of the body (1). FIG. 1 also shows a cap member (3) covering the opening (2).

The container body (1) has a surrounding side wall (4) which is provided with an accordion-shaped contour (5) on its surface between the opening (2) and the bottom of the body (1) across the height of the container body (1).

For use, the container body (1) may be filled with liquid such as mineral water using any conventional means, and then sealed with a cap member (3) before it is put on a market. Such a filled container body (1) may be transported almost safely even under oscillation since the accordion like contour (5) of the side wall (4) may provide a buffering function.

Now, the container body (1) is emptied and compressed into a direction toward the middle of the body (1). The container may be easily compressed due to flexibility and plasticity of the container body (1) as well as the accordion-shaped contour (5) of the side wall (4).

Alternatively, the container body (1) may be placed on the ground and then crushed by foot if the container body cannot be squashed easily by hand.

The squashed container body (1) may have thus sufficiently reduced volume.

The present inventors put conventional green tea bottles (500 ml; height 21 cm×radius 7 cmø) which are commercially available to the test, by compressing the bottles after making their side walls (4) an accordion-shaped contour (5) as that of the present invention. The results showed that all the container bodies (1) tested were compressed to one-fourth of its original height, which was equal to 5 cm or less. These heights were equal to about two-fold (2L) of those of the relatively hard taper portions (11) of respective container bodies (1), the taper portions (11) being provided just below the opening (2) of the container body (1).

It should be easily understood that such compressed bottles may be easily transported for, for example, recycling since their size are now one-fourth or smaller than their original size. The problem is whether the container bodies (1) can be kept in a compression form prior and during transportation. Various containers made of different materials were tested for this point though results showed that some were kept compressed for a long period of time, others for several hours, and even others had only very short period of time such as a few minutes and soon to tend to recover their original shapes.

Figure 9:
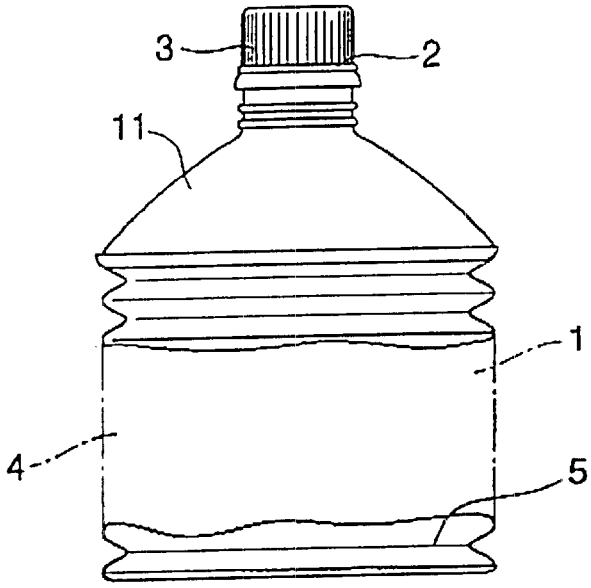
FIG. 9 shows a front view of the container in a compressed state which is provided with a means for retaining its substantially reduced volume according to Example 1.

Accordingly, the container body (1) is capped again with a cap member (3) at the opening (2) to prevent air introduction into the container body (1) after compression, as shown in FIG. 9, so that the container body (1) can keep its compressed form.

However, a capping member (3) may often be discarded or lost after detached from the container body (1) and thus cannot be capped with a cap member (3) after compression of the container body (1).

Figure 10:
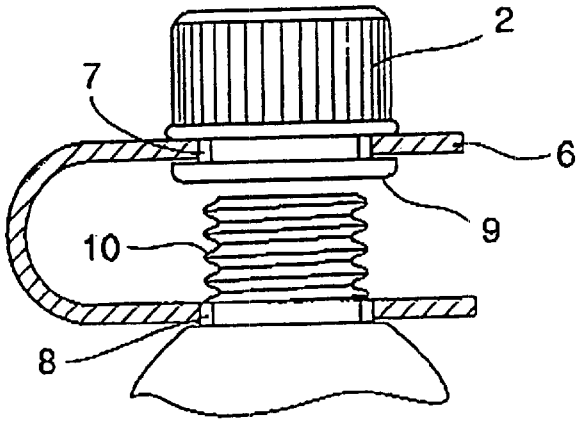
FIG. 10 shows a belt which permanently connects the cap and the container body.

Accordingly, improvement in the present invention is to attach the capping member (3) permanently to the container body (1). For example, FIG. 10 shows a belt (6) which is made of thin, flexible, plastic resin plate, the plate with openings (7) and (8) close to both ends. The cap (3) has a circumferential side wall and a dovetail groove (9) on the periphery of the sidewall. One of the above-described openings (7) provided in the belt (6) is fitted into the dovetail groove (9) while the other (8) is fitted into the proximal end of screw portion (10) provided on the outer surface of the opening (2) of the container body (1).

As a result, the cap (3) is permanently fixed to the container body (1) so that it may not be lost after once detached. Thus, the container body (1) can be kept compressed by recapping with the cap (3) on the opening of the container body (1) after compression.

As already described above, the compressed body (1) has a height equal to about two-fold (2L) of that of the taper portion (5) (L). In another embodiment, the container body (1) may be further compressed into smaller size.

Figure 11:
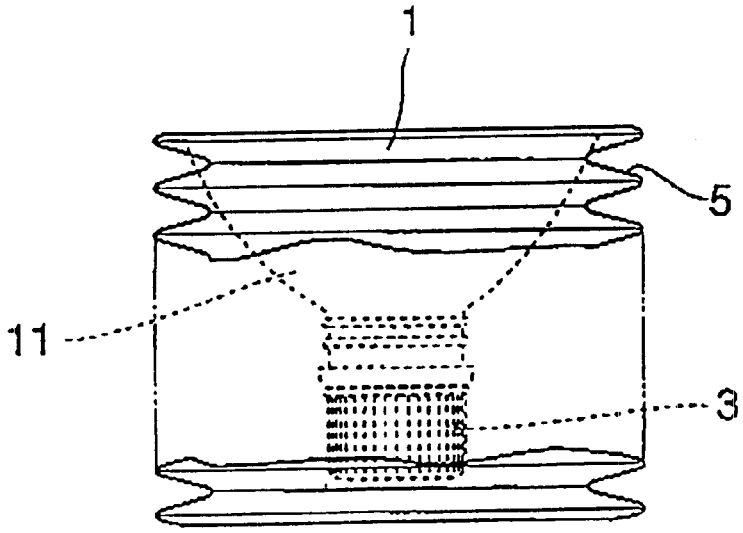
FIG. 11 shows a front view of the container body in a compressed state which is provided with a means for retaining its substantially reduced volume according to Example 5.

In this example, as shown in FIG. 11, a threaded neck portion, the taper portion (II) and opening (2) of the container body (1), and optionally a loosely fitted cap (3) are flipped into the container body (1) when the container body (1) is compressed such that these parts may be accommodated in the container body and the neck portion and the taper portion collapse inside-out with their inside surface facing out.

EXAMPLE 2

In alternative embodiment, the container body (1) may be compressed by applying a horizontal force (not a vertical force) in order to substantially reduce the volume of the container body (1).

The collapsible synthetic resin liquid container of the invention, as depicted in FIG. 11, comprises: a collapsible container body (1) having a bottom and a side wall (4) made of flexible and relatively hard plastic synthetic resin, and a form that resists oscillation and vertical stress during transport with liquid therein and facilitates reducing the volume of the container body (1) by applying a vertical and/or twisting force which collapses a portion of the container body (1) from an extended state to a collapsed state when the container body (1) is empty; the side wall (4) includes a collapsible upper body portion and a collapsible lower body portion, the collapsible upper body portion having a resilient threaded neck portion and a taper portion (11), when the collapsible upper body portion is in an extended state the resilient threaded neck portion includes a cap opening (2) at the upper edge of the resilient threaded neck portion and the taper portion (11) extends below the resilient threaded neck portion, and an upper end rim of the collapsible lower body portion formed so that the resilient threaded neck portion and the taper portion (11) are collapsed inside-out with formerly inside surfaces of the neck portion and the taper portion (11) facing outwardly thereby disposing the cap opening (2) below the neck portion and the taper portion (11); a cap (3) covering the cap opening (2) from the bottom and releasably and threadably engaged to the resilient threaded necked potion when the collapsible upper body portion is collapsed with inside surfaces of the neck portion and the taper portion (11) facing outwardly, the cap (3) is adapted to cover the cap opening (2) from the top and releasably and threadably engage the resilient threaded necked potion when the collapsible upper body portion is extended.

Figure 2:
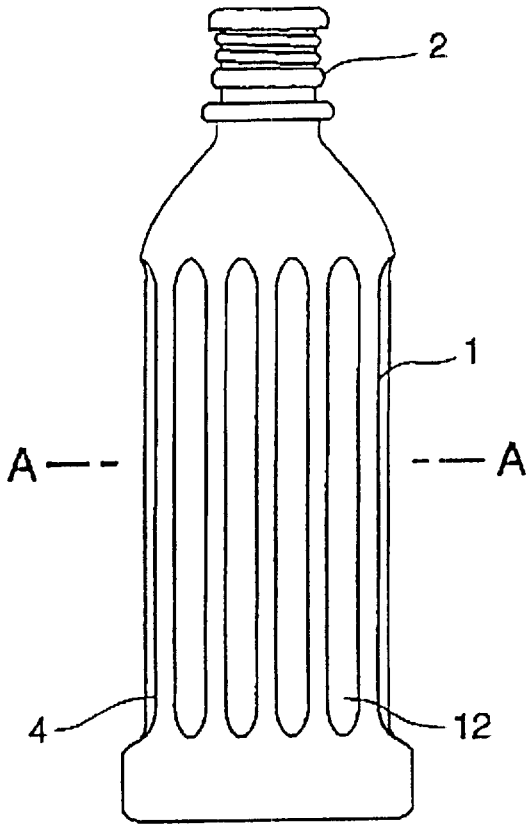
FIG. 2 shows a front view of the container body of the present invention according to Example 2.
Figure 3:
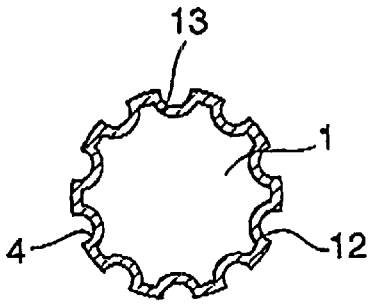
FIG. 3 shows a cross-sectional view of the container body cut from FIG. 2, line a—a.

Particularly, as shown in FIG. 2, the container body (1) may have a plurality of grooves (12) provided on the outer surface thereof with each groove running into the longitudinal direction and being evenly spaced each other. The container body (1) has a star-shaped cross-section (13) as shown in FIG. 3.

Figure 4:
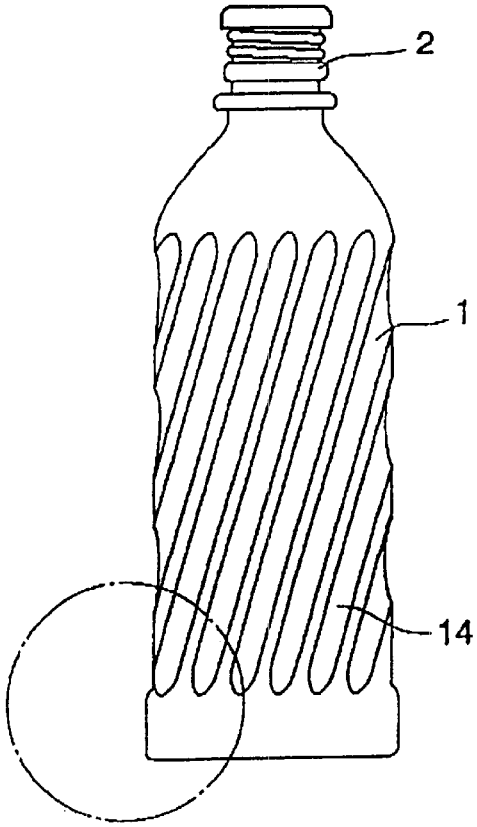
FIG. 4 shows a front view of the container body of the present invention according to Example 2.
Figure 5:
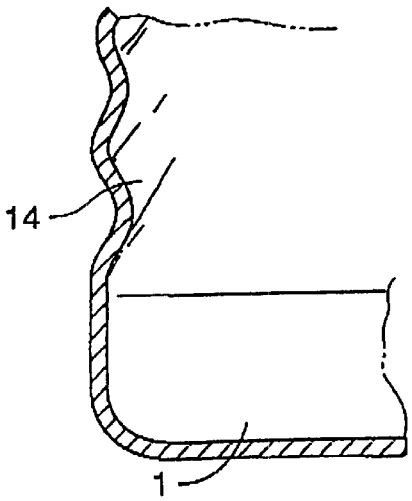
FIG. 5 shows an expanded view of a portion in the dashed line circle shown in FIG. 2.

Alternatively, a number of oblique grooves (14) may be formed on the side wall of the container body for horizontal compression as shown in FIGS. 4 and 5.

In summary, the emptied container bodies (1) shown in FIGS. 2 to 5 could be reduced to a size equal to one-third of their original sizes by compressing of the container body (1) them in such a similar manner as laundry is squeezed to remove moisture.

Figure 6:
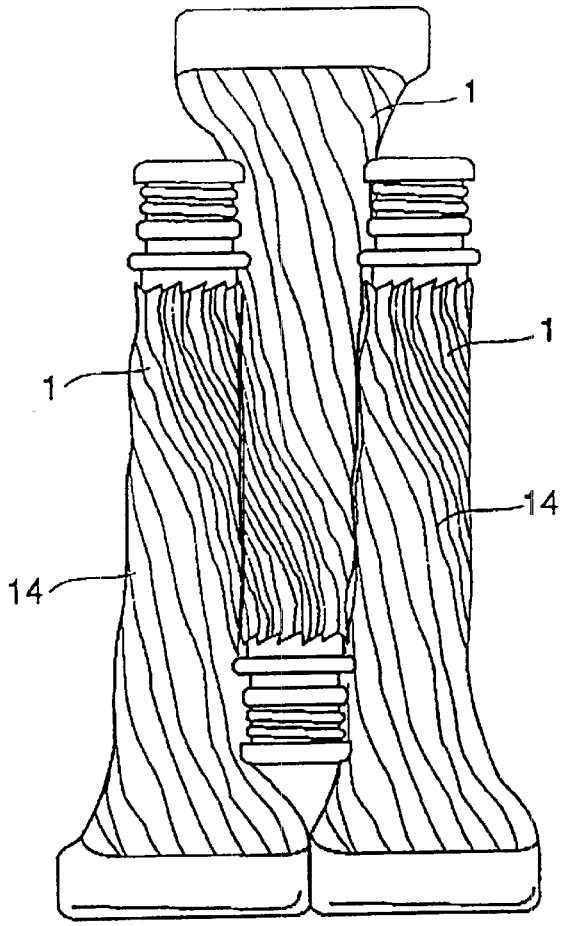
FIG. 6 shows a front view of the containers with substantially reduced volume which are arranged for space saving according to Example 2.

The container body (1) may be capped with a cap (3) after compressed to keep it compressed as described above. A lot of compressed containers (1) can be transported by arranging them in a line with each containers (1) being placed upside down shown in FIG. 6.

EXAMPLE 3

In another embodiment, the container body (1) may be compressed by applying both vertical and horizontal forces.

Figure 7:
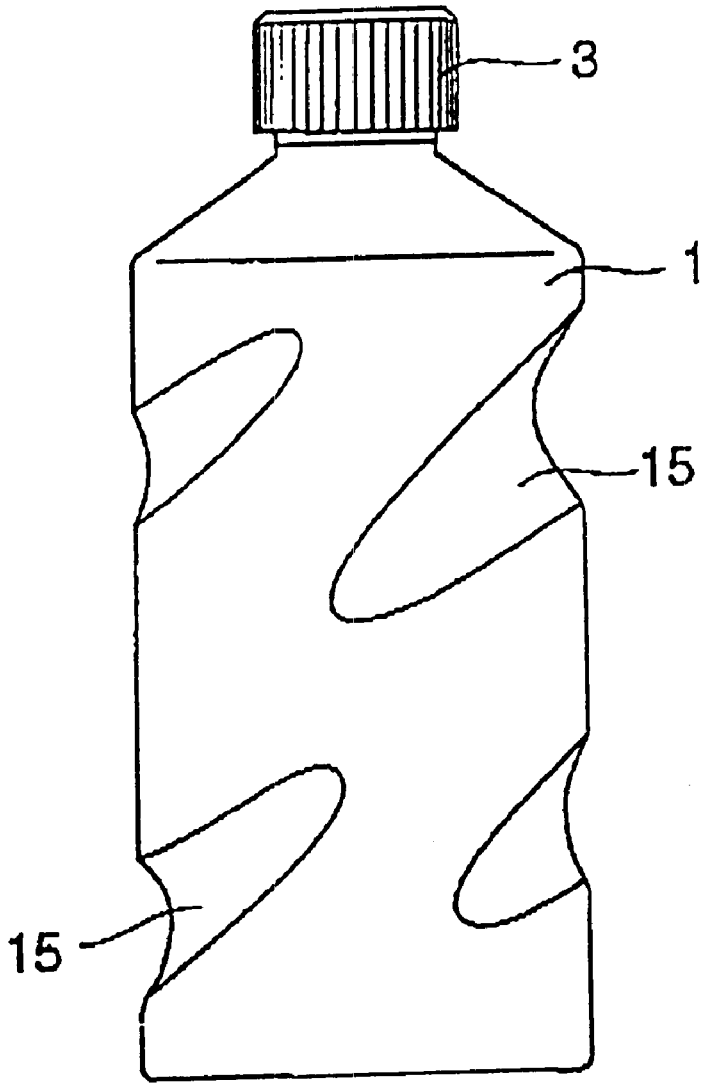
FIG. 7 shows a front view of the container body of the present invention according to Example 3.
Figure 8:
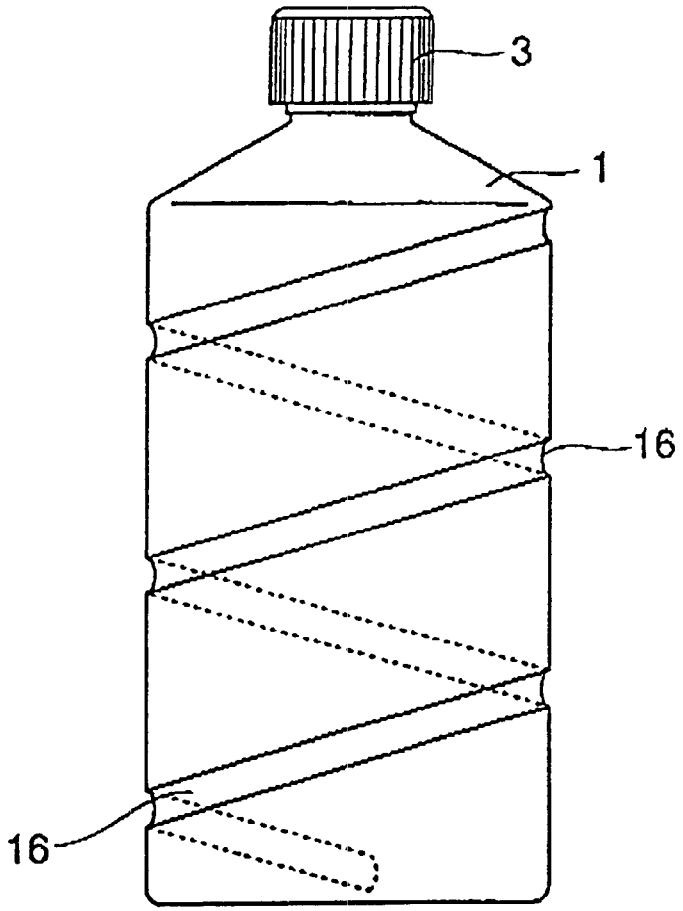
FIG. 8 shows a front view of the container body of the present invention according to Example 4.

Particularly, the container body (1) has a number of recesses such as oblique grooves (15) formed on the surrounding wall (4) thereof as shown in FIG. 7, or a continuous spiral groove (16) on the side wall thereof arranged with each parallel line spaced each other in a oblique but relatively horizontal direction as shown in FIG. 8. Of course, in the case of the container body (1) in FIG. 8 the groove (16) can be discontinuous.

Thus, an empty container body (1) may be easily compressed merely by applying a vertical pressure since, due to such configuration, not only vertical force but also another force in turning direction are generated and transmitted to the container body (1) such that synthetic force of the two may easily press the container body down.

EXAMPLE 4

Figure 12:
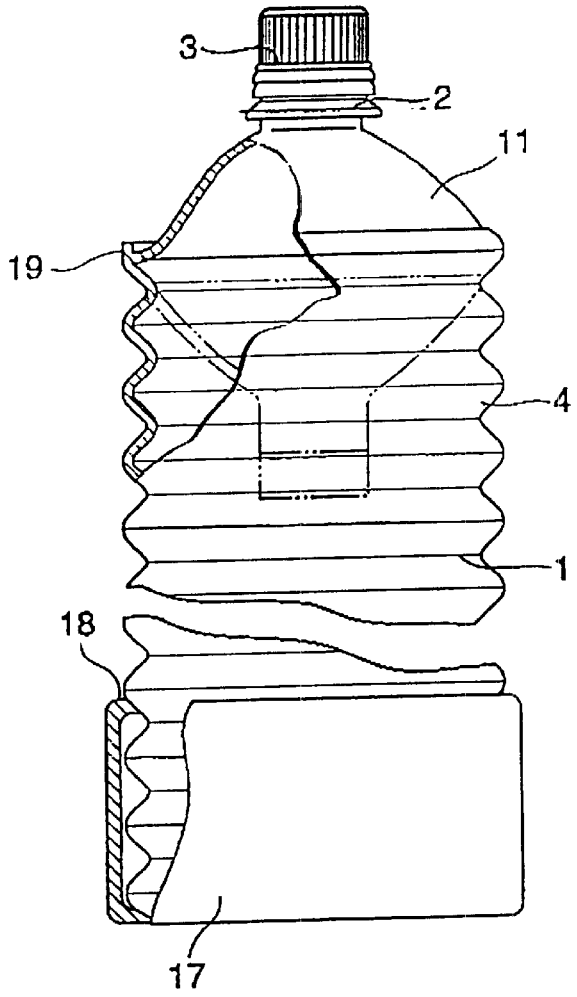
FIG. 12 shows a front view of the container body according to Example 5 in its normal state, which is provided with a means for retaining its substantially reduced volume once the container is compressed.

Various other examples of means for keeping the container body (1) in a compressed form may be contemplated. For example, cover members (17) are shown in FIGS. 12 and 13, which are fitted on the lower portion of container body (1).

These cover members (17) are generally manufactured from the same material as the container body (1), and may be sold along with the container body (1) containing liquid therein. The cover member (17) is shaped like a bowl with a claw (18) extruding inwardly at the upper open rim.

Thus, once compressed in vertical direction the empty container body (1) is accommodated in the cover member (17) so that the empty container body (1) can keep its compression form.

Figure 13:
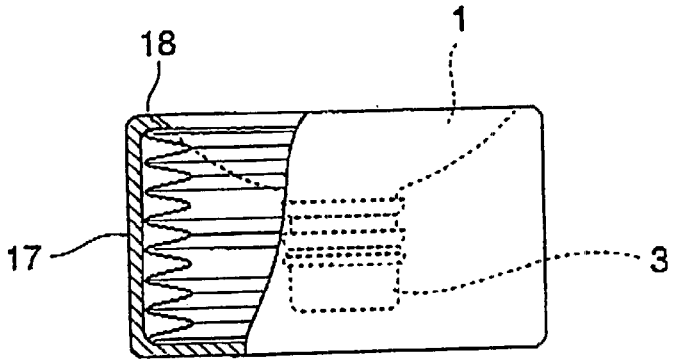
FIG. 13 shows a front view of the container body according to Example 5 in its compressed state, which is provided with a means for retaining its substantially reduced volume once the container is compressed.

One example is shown in FIG. 13 in which the container body (1) has an accordion-shaped contour (5), i.e., closely arranged parallel grooves to form the contour, on the side wall (4) thereof. In this example, the top protrusion of the accordion contour (5)—i.e., the protrusion (19) of the accordion contour (5) just below the taper portion (11)—will engage with the claw (18) of the cover (17). Accordingly, it is important to make the height or depth of the cover member (17) equal to that of the container body (1) in a maximally compressed state.

Preferably, the top protrusion (19) of the container body (1) may have a larger radius than other protrusions in the same accordion contour as shown in FIG. 12.

Figure 14:
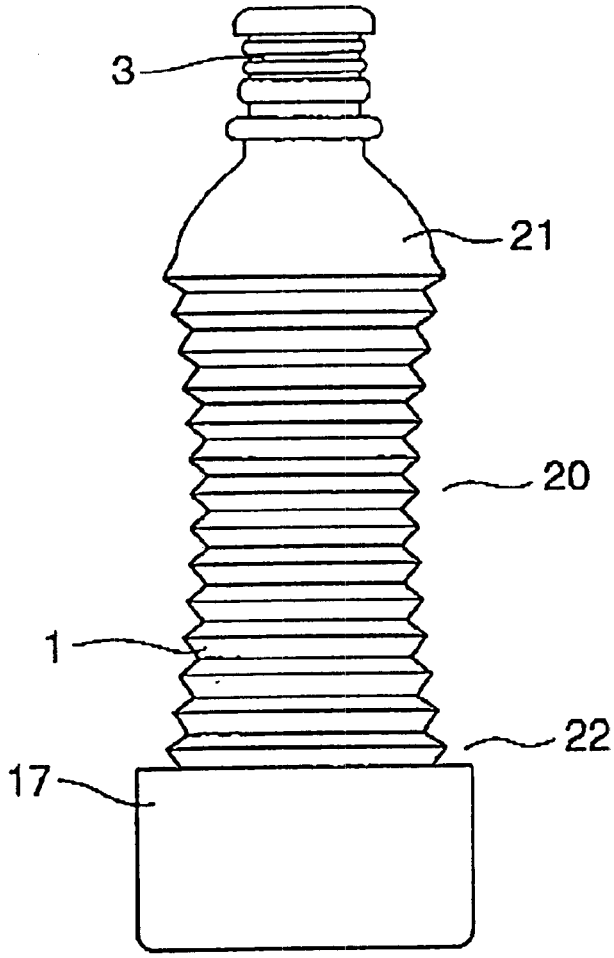
FIG. 14 shows a front view of the container body according to Example 6 in its normal state, which is provided with a means for retaining its substantially reduced volume once the container is compressed.
Figure 15:
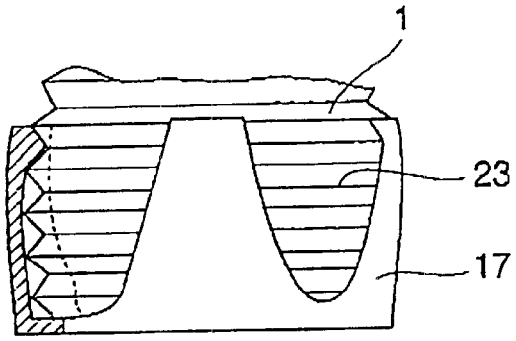
FIG. 15 shows a front view of the container body according to Example 2 in its compressed state, which is provided with a means for retaining its substantially reduced volume once the container is compressed.

In this case, the container body (1) may have an accordion contour with each protrusion therein having successively reduced radiuses toward the middle portion (20) across the container length such that the side wall of the container body (1) may be almost evenly and horizontally folded to be accommodated in the next cover member (17) when the container body (1) is pressed into the cover member (17) as shown in FIG. 14, thus enabling easy compressing operation of the container. The cover member (17) may be formed as a tube or another form such that it has a discontinuous side wall with a hole or holes (23) from that of the as shown in FIG. 16.

EXAMPLE 5

Figure 16:
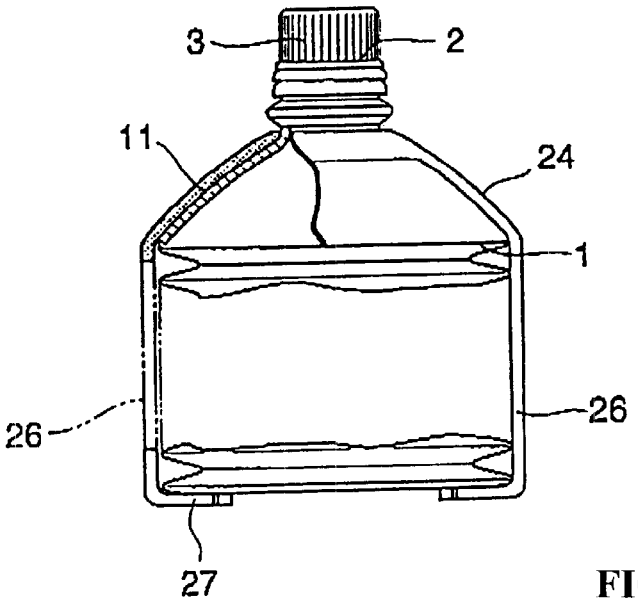
FIG. 16 shows a front view of the container body according to Example 7 in its compressed state, which is provided with a means for retaining its substantially reduced volume once the container is compressed.
Figure 17:
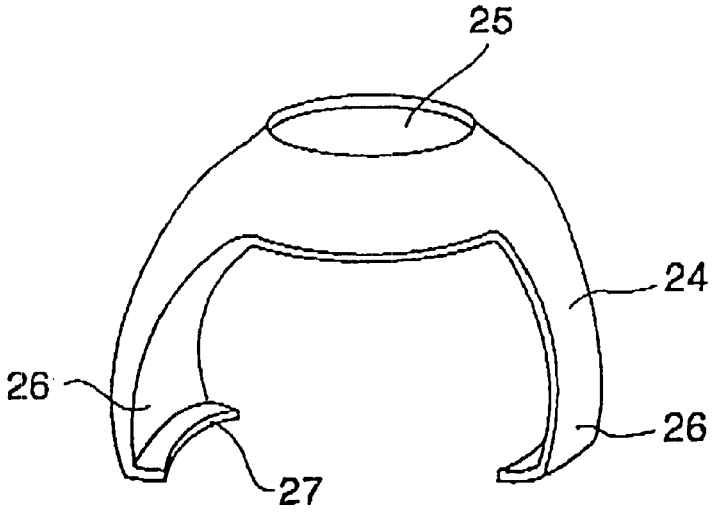
FIG. 17 shows a front view of retaining means for retaining a container body compressed according to Example 8.
Figure 18:
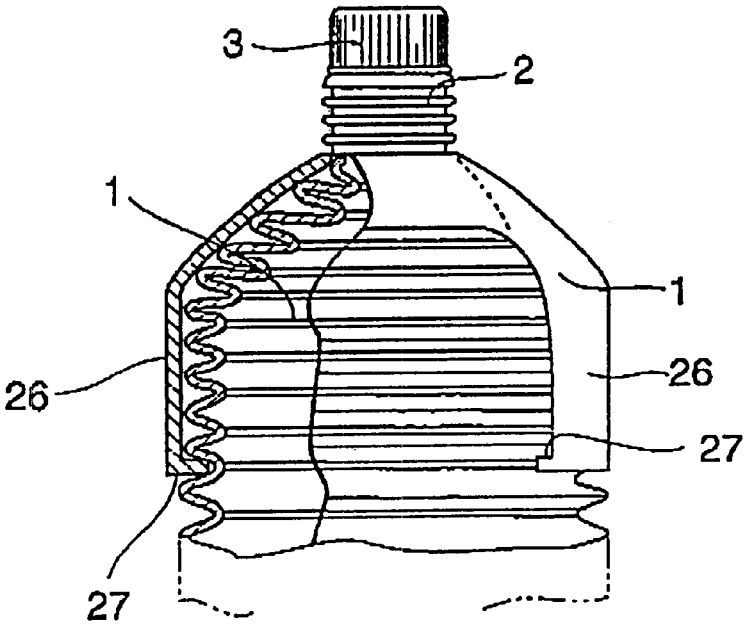
FIG. 18 shows a front view of the container which has such a configuration that it may have substantially reduced volume when compressed according to Example 8.

The cover member (15) may be one which is fit into the lower portion of the container body (1) as described above, or a retainer (24) generally manufactured from the same material as the container body (1) in any form such as those shown in FIGS. 16 to 18.

For example, the retainer (24) may comprise a disk having a hole (25) at its center in which the opening (2) of the container body (1) can fit, and a plurality of leg members (26) under the disk. The leg members (26) can be bumped into engagement with the side wall of the container body (1), and has a claw member (27) at their ends which is adjusted to fit on the container body (1).

Typically the retainer (24) may be put on the market together with the container body (1). When emptied container body (1) is compressed, the claw members (27) of the retainer (24) are engaged with the bottom surface of the container body (1) thereby enabling the container to keep its compression form.

In summary, the present invention could provide substantially reduced volume of an after-used container body, resulting in saving garbage storage space, thereby enabling a large amount of after-used containers to be transported at one time. This space-saving contributes to expansion of recycling such containers.

Further, the container body of the present invention is provided with a retainer means for keeping its compression form so that once compressed the container may not return to its normal shape.

The above examples are provided to illustrate the invention but not limit its scope. Other variations of the invention will be readily apparent to one of ordinary skill in the art and are encompassed by the appended claims.

What is claimed is:

1. A collapsible synthetic resin liquid container comprising:

a collapsible container body having a bottom and a side wall made of flexible and relatively hard plastic synthetic resin, and a form that resists oscillation and vertical stress during transport with liquid therein and facilitates reducing the volume of the container body by applying a vertical and/or twisting force which collapses a portion of the container body from an extended state to a collapsed state when the container body is empty;

the side wall includes a collapsible upper body portion and a collapsible lower body portion, the collapsible upper body portion having a resilient threaded neck portion and a taper portion, when the collapsible upper body portion is in an extended state the resilient threaded neck portion includes a cap opening at the upper edge of the resilient threaded neck portion and the taper portion extends below the resilient threaded neck portion, and an upper end rim of the collapsible lower body portion formed so that the resilient threaded neck portion and the taper portion are collapsed inside-out with formerly inside surfaces of the neck portion and the taper portion facing outwardly thereby disposing the cap opening below the neck portion and the taper portion;

a cap covering the cap opening from the bottom and releasably and threadably engaged to the resilient threaded necked potion when the collapsible upper body portion is collapsed with inside surfaces of the neck portion and the taper portion facing outwardly, the cap is adapted to cover the cap opening from the top and releasably and threadably engage the resilient threaded necked potion when the collapsible upper body portion is extended.

2. The collapsible synthetic resin liquid container according to claim 1, wherein the side wall is thin and the collapsible lower body portion having at least two parallel grooves so closely arranged to form an accordion-shaped contour thereon for facilitating an operation of substantially reducing the volume of container body.

3. The collapsible synthetic resin liquid container according to claim 2, wherein the grooves are recesses.

4. The collapsible synthetic resin liquid container according to claim 2, wherein the grooves are spaced apart from each other.

5. The collapsible synthetic resin liquid container according to claim 2, wherein the grooves are spaced apart from each other evenly over the collapsible lower body portion.

6. The collapsible synthetic resin liquid container according to claim 1, wherein a height of said collapsible upper body portion being approximately equal to one-fourth of a height of the collapsible container body.

7. The collapsible synthetic resin liquid container according to claim 1, wherein a height of said collapsible upper body portion being equal to one-fourth of a height of the collapsible container body.

8. The collapsible synthetic resin liquid container according to claim 1, wherein the side wall is thin and the lower body portion has at least two parallel grooves closely arranged to form an accordion contour thereon for substantially reducing the volume of container body.

9. The collapsible synthetic resin liquid container according to claim 1:

wherein the collapsible lower body portion having a cylindrical accordion-shaped contour including a plurality of pleats of a uniform shape, a smallest height of the reduced volume of the container being substantially equal to a height of said collapsible upper body portion which is maintained the same before and after the volume of the container is reduced, and a maximum radius of the collapsible upper body portion is the same as a maximum radius of the collapsible lower body portion.

10. The collapsible synthetic resin liquid container according to claim 9, wherein the smallest height of the reduced volume of the container is substantially equal to two-fold a height of the taper portion.

11. The collapsible synthetic resin liquid container according to claim 9, wherein a height of said taper portion is substantially equal to one-half of a height of said collapsible upper body portion.

12. The collapsible synthetic resin liquid container according to claim 9, wherein a height of said taper portion is substantially equal to twice of a height of each said pleats.

* * * * *